US009136625B2

(12) United States Patent
Yu et al.

(10) Patent No.: US 9,136,625 B2
(45) Date of Patent: Sep. 15, 2015

(54) CONNECTOR ASSEMBLY WITH PLATE FOR CONTACT NESTING AND EFFECTIVE HEAT DISSIPATION PATH

(71) Applicant: ALLTOP ELECTRONICS (SUZHOU) CO., LTD, Taicang, JiangSu Province (CN)

(72) Inventors: Wang-I Yu, Jhonghe (TW); Hung-Chi Tai, Jhonghe (TW); Yung-Chih Hung, Jhonghe (TW); Kuo-Cheng Liu, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 29 days.

(21) Appl. No.: 14/065,016

(22) Filed: Oct. 28, 2013

(65) Prior Publication Data

US 2015/0017830 A1 Jan. 15, 2015

(30) Foreign Application Priority Data

Jul. 15, 2013 (CN) ..... 2013 1 0295105

(51) Int. Cl.
*H01R 13/523* (2006.01)
*H01R 12/72* (2011.01)
*H01R 12/70* (2011.01)

(52) U.S. Cl.
CPC ..... *H01R 12/724* (2013.01); *H01R 12/7088* (2013.01)

(58) Field of Classification Search
CPC ..... H01R 13/523; H01R 13/5227; H01R 23/7073; H01L 23/4006
See application file for complete search history.

(56) References Cited

U.S. PATENT DOCUMENTS

| | | | | |
|---|---|---|---|---|
| 5,007,858 | A * | 4/1991 | Daly et al. | 439/498 |
| 7,158,379 | B2 * | 1/2007 | Sanders et al. | 361/703 |
| 7,666,025 | B2 * | 2/2010 | Cheng et al. | 439/485 |
| 7,726,982 | B2 * | 6/2010 | Ngo | 439/79 |
| 8,038,466 | B1 * | 10/2011 | Tai et al. | 439/485 |
| 8,043,097 | B2 * | 10/2011 | Ngo et al. | 439/79 |
| 8,393,916 | B2 * | 3/2013 | Yu et al. | 439/485 |
| 8,591,265 | B2 * | 11/2013 | Huang et al. | 439/660 |
| 8,702,445 | B2 * | 4/2014 | Yu et al. | 439/485 |
| 8,740,641 | B2 * | 6/2014 | Rostami | 439/502 |
| 2008/0207029 | A1 * | 8/2008 | Defibaugh et al. | 439/206 |
| 2008/0318464 | A1 * | 12/2008 | Yuan | 439/485 |
| 2010/0048056 | A1 * | 2/2010 | Daily et al. | 439/485 |
| 2011/0076871 | A1 * | 3/2011 | Yu et al. | 439/345 |
| 2011/0287658 | A1 * | 11/2011 | Yu et al. | 439/485 |
| 2013/0065414 | A1 * | 3/2013 | Yu et al. | 439/206 |
| 2013/0109224 | A1 * | 5/2013 | Chin et al. | 439/485 |
| 2013/0260593 | A1 * | 10/2013 | Tai et al. | 439/345 |
| 2013/0316568 | A1 * | 11/2013 | Yu et al. | 439/485 |
| 2013/0330961 | A1 * | 12/2013 | Peng et al. | 439/485 |

* cited by examiner

*Primary Examiner* — Gary Paumen
(74) *Attorney, Agent, or Firm* — Sughrue Mion, PLLC

(57) ABSTRACT

A connector assembly includes a plug connector and a receptacle connector mateable with each other. The plug connector includes a plug insulative housing and a pair of plug power contacts. The plug insulative housing includes a first plug cavity, a first plate cantileveredly extending into the first plug cavity, and upper and lower plug contact slots in communication with the first plug cavity. The pair of plug power contacts are respectively received in the upper and lower plug contact slots. Each plug power contact includes a flat contacting section exposed to the first plug cavity and a first soldering section. The flat contacting sections are positioned on upper and lower surfaces of the first plate, respectively. The plug connector and the receptacle connector define heat dissipation channels in communication with each other in order that generating heat can be effectively dissipated to the air.

20 Claims, 13 Drawing Sheets

CONNECTOR ASSEMBLY WITH PLATE FOR CONTACT NESTING AND EFFECTIVE HEAT DISSIPATION PATH

BACKGROUND OF THE INVENTION

1. Field of the Invention

The present invention relates to a connector assembly, and more particularly to a connector assembly with a plate for contact nesting and an effective heat dissipation path.

2. Description of Related Art

With rapid development of electronic technologies, electrical connectors have been widely used in electronic devices for exchanging information and data with external devices. A conventional connector usually includes an insulative housing and a plurality of contacts received in the insulative housing. A connector assembly includes a plug connector and a receptacle connector for mating with the plug connector.

In order to meet the requirements of stable signal transmission and high effective transmission of the electronic devices, strong mating stabilization of the plug connector and the receptacle connector needs to be ensured. However, since there are many kinds of plug connectors and receptacle connectors, incorrectly matching always happens which greatly influences mating effects of the plug connectors and the receptacle connectors. Besides, if the connector assembly is applied for power transmission, effective heat dissipation is another problem must be considered.

Hence, it is desirable to provide an improved connector assembly to solve the above problems.

BRIEF SUMMARY OF THE INVENTION

The present invention provides a connector assembly including a plug connector and a receptacle connector mateable with each other. The plug connector includes a plug insulative housing and a pair of plug power contacts. The plug insulative housing includes a first mating surface, a first plug cavity extending through the first mating surface along a transverse direction, and a first plate cantileveredly extending into the first plug cavity along the transverse direction. Besides, the plug insulative housing defines upper and lower plug contact slots in communication with the first plug cavity. The pair of plug power contacts are respectively received in the upper and lower plug contact slots. Each plug power contact includes a flat contacting section exposed to the first plug cavity and a first soldering section. The flat contacting sections are positioned on upper and lower surfaces of the first plate, respectively.

The receptacle connector includes a receptacle insulative housing at least partly received in the first plug cavity of the plug connector and a pair of receptacle power contacts for mating with the plug power contacts. The receptacle insulative housing includes a second mating surface, a first receptacle cavity extending through the second mating surface along the transverse direction, and upper and lower receptacle contact slots in communication with the first receptacle cavity. Each receptacle power contact includes a resilient contacting section engaging with corresponding flat contacting section of the plug power contact.

The plug insulative housing defines a first heat dissipation channel in communication with the first plug cavity, and the receptacle insulative housing defines a second heat dissipation channel in communication with the first receptacle cavity. The first heat dissipation channel and the second heat dissipation channel are in communication with each other. Both the first heat dissipation channel and the second heat dissipation channel are exposed to the air and together form a first path through which heat generated by the flat contacting sections and the resilient contacting sections can be effectively dissipated to the air.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
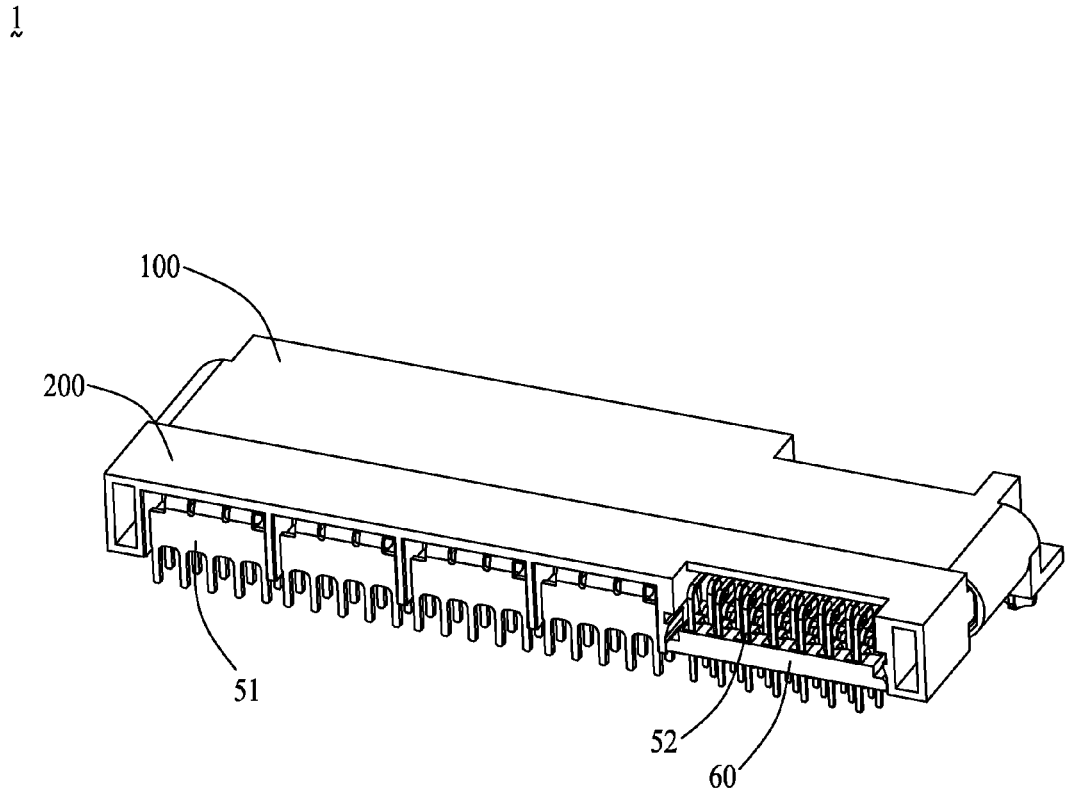
FIG. 1 is a perspective view of a connector assembly with a receptacle connector partly inserted in a plug connector, in accordance with an illustrated embodiment of the present invention.

Reference will now be made to the drawing figures to describe the embodiments of the present invention in detail. In the following description, the same drawing reference numerals are used for the same elements in different drawings.

Referring to FIG. 1, the present invention discloses a connector assembly 1 for being mounted to circuit boards (not shown). The connector assembly 1 includes a plug connector 100 and a receptacle connector 200 mateable with each other for power and/or signal transmission.

Figure 2:
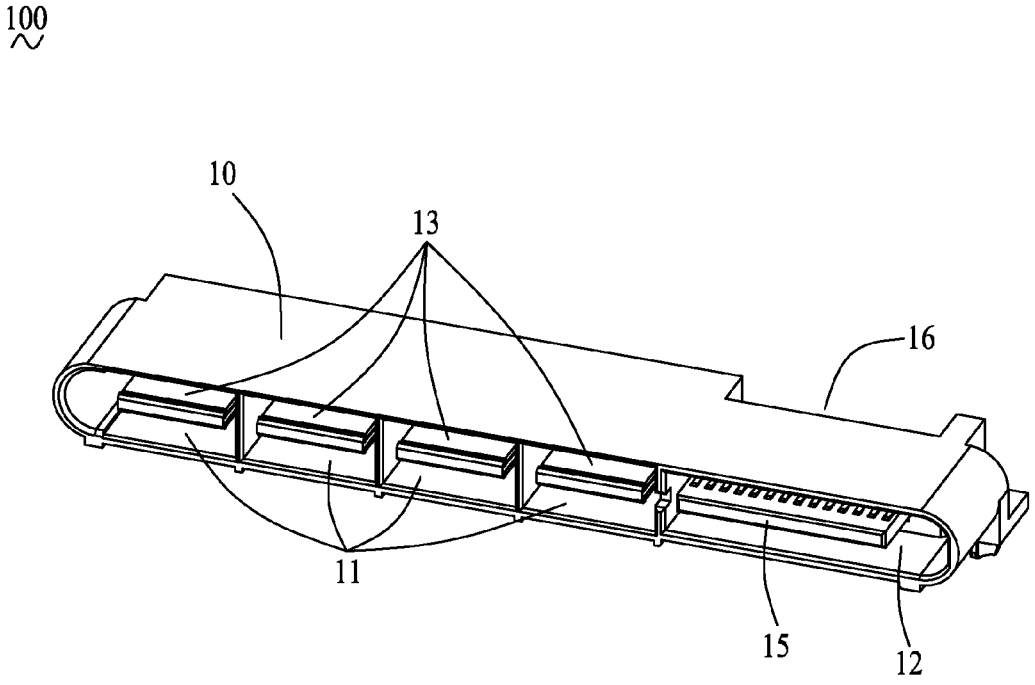
FIG. 2 is a perspective view of a plug connector as shown in FIG. 1.
Figure 3:
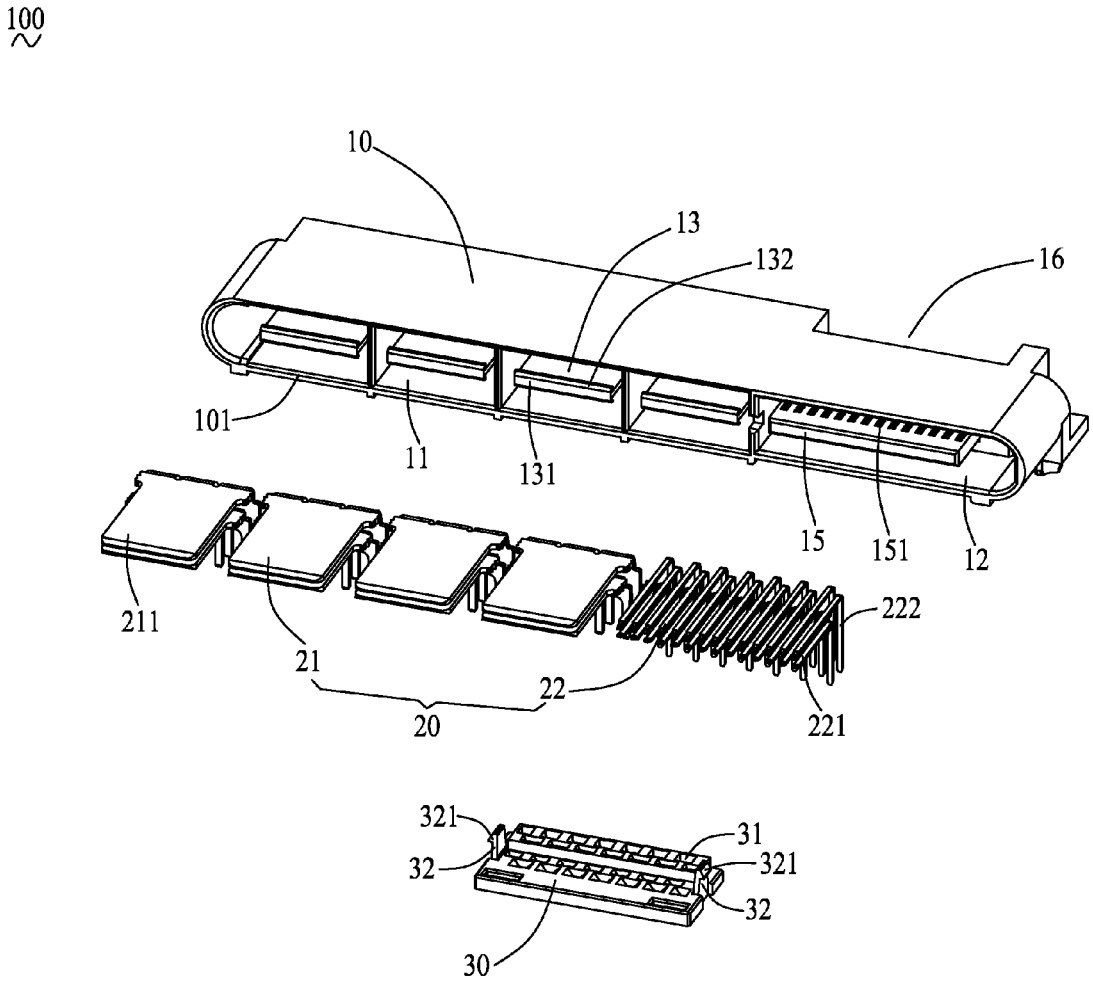
FIG. 3 is an exploded view of the plug connector as shown in FIG. 2.

Referring to FIGS. 2 and 3, the plug connector 100 includes a plug insulative housing 10 extending along a longitudinal direction, a plurality of plug contacts 20 fixed to the plug insulative housing 10 and a spacer 30 for mating with the plug insulative housing 10. The plug contacts 20 include four pairs of plug power contacts 21 and a plurality of plug signal contacts 22.

Figure 4:
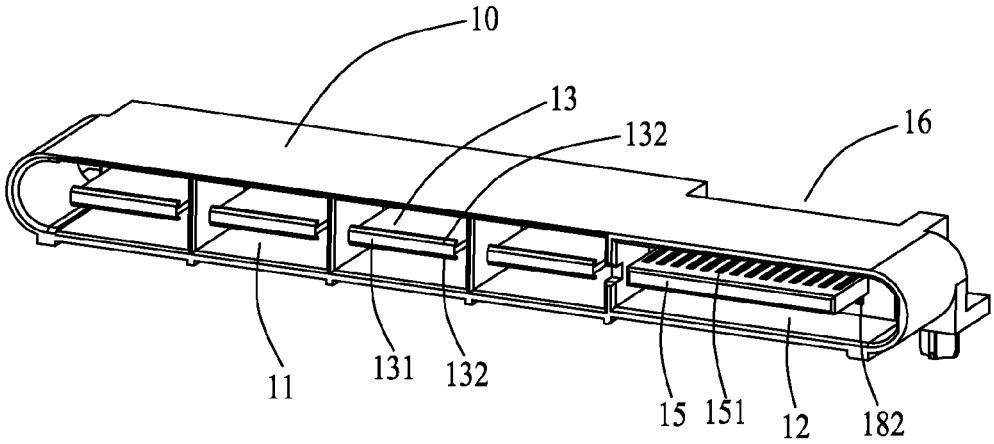
FIG. 4 is a perspective view of a plug insulative housing of the plug connector as shown in FIG. 3.
Figure 5:
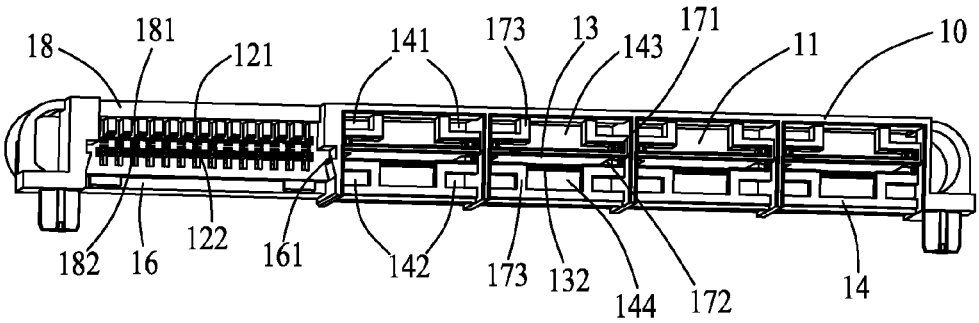
FIG. 5 is another perspective view of the plug insulative housing as shown in FIG. 4.

Referring to FIGS. 4 and 5, the plug insulative housing 10 includes a first mating surface 101, four first plug cavities 11 extending through the first mating surface 101 along a transverse direction perpendiucalr to the longitudinal direction, and four first plates 13 cantileveredly extending into corresponding first plug cavities 11 along the transverse direction. Since four power ports of the plug connector 100 are similar, only one of them will be described in detail hereinafter. Each first plug cavity 11 is enclosed by four peripheral walls (i.e., a top wall, a bottom wall and a pair of side walls) and a first rear wall 14 (shown in FIG. 5) connecting the four peripheral walls. The first plate 13 integrally extends from the first rear wall 14. As shown in FIG. 5, the first rear wall 14 is located at a rear of the first mating surface 101 along the transverse direction. Referring to FIGS. 3 and 4, the plug insulative housing 10 includes a front head 131 formed at a distal end of each first plate 13. The front head 131 includes a pair of upper and lower protrusions 132 extending along a vertical direction perpendicular to the transverse direction and the longitudinal direction. The front head 131 and the first plate 13 are together of a T-shaped cross-section. The front head 131 is adapted for protecting the plug power contacts 21 so as to prevent a mismatch connector from being incorrectly inserted into the plug connector 100.

Referring to FIG. 5, the plug insulative housing 10 defines upper and lower plug contact slots 171, 172 in communication with the first plug cavity 11 for fastening the plug power contacts 21. The upper and lower plug contact slots 171, 172 extend rearwardly through the first rear wall 14 along the transverse direction. The first plate 13 is located between the upper and lower plug contact slots 171, 172 along the vertical direction. Besides, the first rear wall 14 includes a plurality of heat dissipation holes extending through. According to the illustrated embodiment of the present invention, the heat dissipation holes include a pair of first holes 141 located above the upper plug contact slot 171 and a pair of second holes 142 located below the lower plug contact slot 142. The first holes 141 and the second holes 142 are formed on and respectively located at four corners of the first rear wall 14. In addition, the first rear wall 14 includes a first slot 143 between the pair of first holes 141 along the longitudinal direction and a second slot 144 between the pair of second holes 142 along the longitudinal direction. The first slot 143 is in communication with the upper plug contact slot 171. The second slot 144 is in communication with the lower plug contact slot 172. Referring to FIG. 5, the first holes 141 and the first slot 143 are separated by separate walls 173 therebetween while taken from a rear view of the plug insulative housing 10. Similarly, the second holes 142 and the second slot 144 are separated by separate walls 173 therebetween while taken from the rear view of the plug insulative housing 10.

Since the plug connector 100 is a hybrid of a power connector and a signal connector, the plug insulative housing 10 defines a heat dissipation channel (not labeled) in communication with the first plug cavity 11 in order that heat generated by the plug power contacts 21 can be effectively dissipated to the air through such heat dissipation channel. According to the illustrated embodiment of the present invention, the pair of first holes 141, the pair of second holes 142, the first slot 143 and the second slot 144 are all in communication with the first plug cavity 11 so as to form the heat dissipation channel.

The plug connector 100 further includes a signal port aside the four power ports along the longitudinal direction. The plug insulative housing 10 includes a second plug cavity 12, a second plate 15 extending into the second plug cavity 12 and a second rear wall 18 at a rear of the second plug cavity 12. The second plate 15 defines a plurality of upper and lower plug contact passageways 121, 122 extending rearwardly through the second rear wall 18. Referring to FIGS. 4 and 5, the second rear wall 18 further includes a plurality of upper heat dissipation slits 181 and a plurality of lower heat dissipation slits 182 extending therethrough along the transverse direction. The upper heat dissipation slits 181 are located above and in communication with the upper plug contact passageways 121. The lower heat dissipation slits 182 are located below and in communication with the lower plug contact passageways 122. The upper heat dissipation slits 181 and the lower heat dissipation slits 182 are arranged in two parallel rows for dissipating heat generating in the signal port. Besides, as shown in FIG. 3, the second plate 15 includes a slit 151 extending therethrough along the vertical direction for dissipating heat as well.

Figure 6:
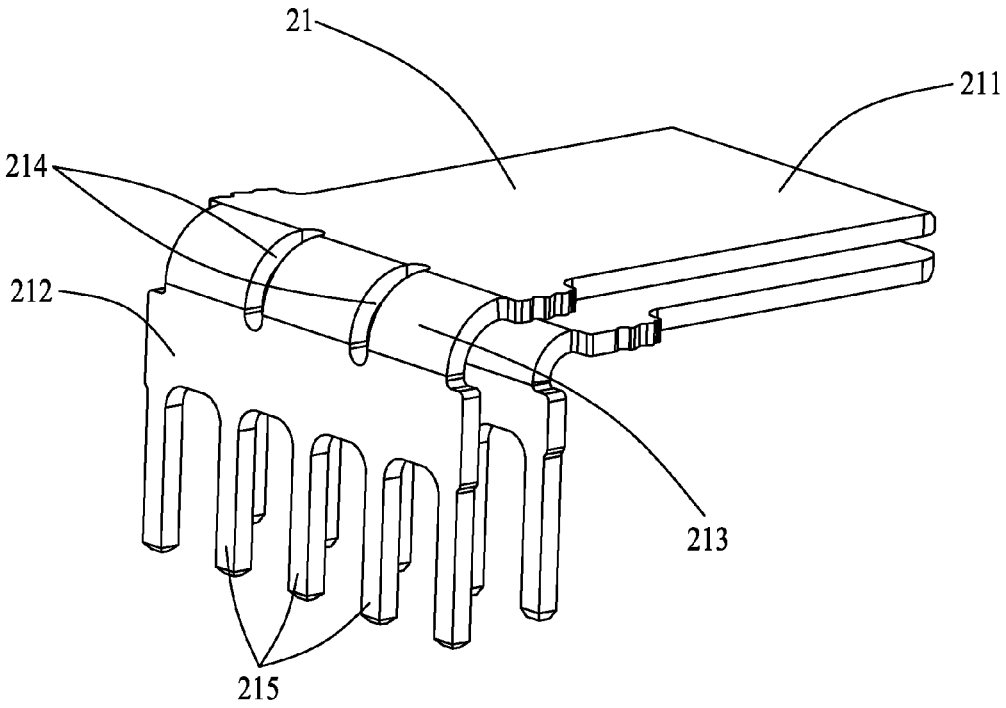
FIG. 6 is a perspective view of a pair of plug power contacts of the plug connector as shown in FIG. 3.

Referring to FIGS. 2, 3 and 6, each pair of plug power contacts 21 are respectively received in the upper and lower plug contact slots 171, 172. Each plug power contact 21 includes a flat contacting section 211 exposed to the first plug cavity 11, a first soldering section 212 for being mounted to a circuit board and a first bending section 213 connected between the flat contacting section 211 and the first soldering section 212. The flat contacting sections 211 of the pair of plug power contacts 21 are positioned on upper and lower surfaces of the first plate 13, respectively. Front edges of the flat contacting sections 211 are restricted by and hid behind the pair of upper and lower protrusions 132, respectively. As a result, the flat contacting sections 211 can be protected by the front head 131 so as to be prevented from contacting a mismatch connector. The first bending section 213 defines at least one heat dissipation slot 214 therethrough. The first soldering section 212 includes a plurality of soldering legs 215 for being soldered to the circuit board.

Figure 7:
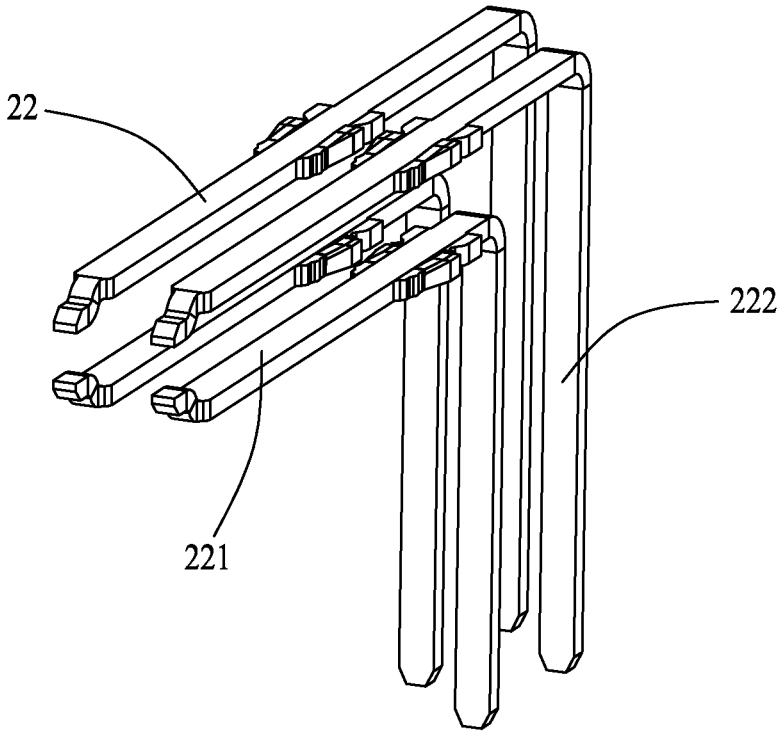
FIG. 7 is a perspective view of a plurality of plug signal contacts of the plug connector as shown in FIG. 3.

Referring to FIGS. 2, 3 and 7, the plug signal contacts 22 are arranged as a matrix. Each plug signal contact 22 includes a flat contacting portion 221 received in the upper or lower plug contact passageways 121, 122, and a first soldering portion 222 for being mounted to a circuit board. Referring to FIGS. 4 and 5, it is understandable that when the plug signal contacts 22 are assembled to the plug insulative housing 10, the upper heat dissipation slits 181 and the lower heat dissipation slits 182 cannot be filled by the plug signal contacts 22. As a result, heat generated by the flat contacting portions 221 can be dissipated to the air through the upper and lower heat dissipation slits 181, 182.

Referring to FIGS. 3 and 5, the plug insulative housing 10 includes an opening 16 at a rear of the second rear wall 18 and a pair of retaining apertures 161 located at opposite sides of the opening 16. In order to organize the first soldering portions 222 of the plug signal contacts 22, the plug connector 100 is provided with a spacer 30 received in the opening 16. The spacer 30 includes a plurality of holes 31 through which the first soldering portions 222 extend and a pair of locking arms 32 extending from lateral sides thereof. Each locking arm 32 includes a hook 321 locked in retaining apertures 161.

Figure 8:
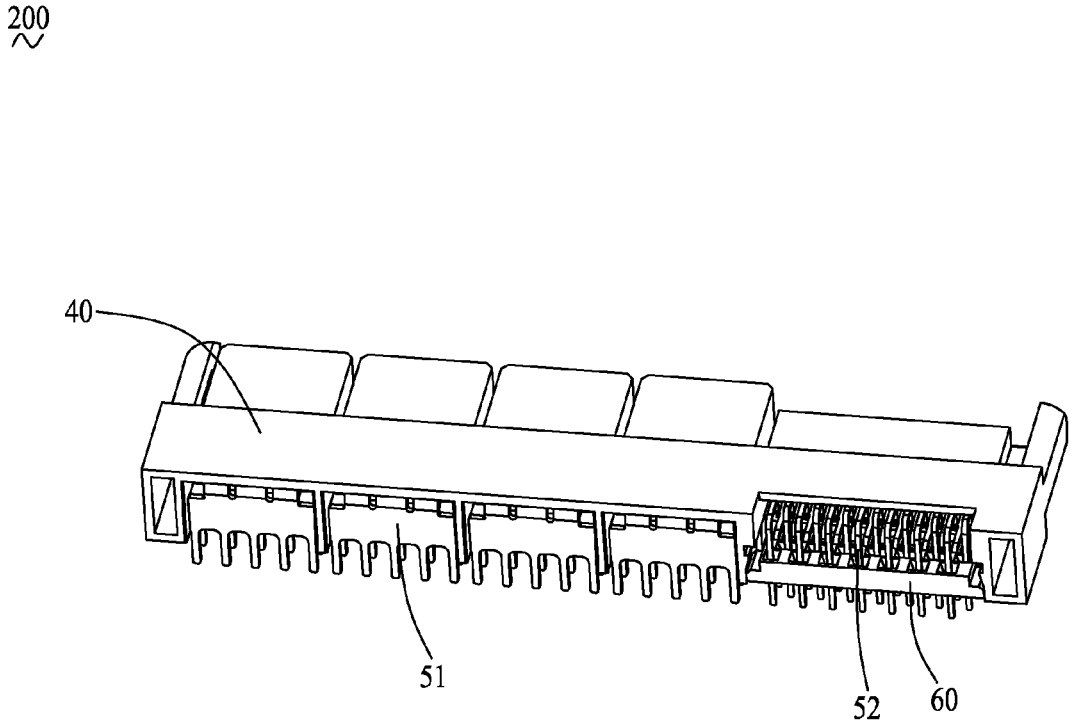
FIG. 8 is a perspective view of a receptacle connector as shown in FIG. 1.
Figure 9:
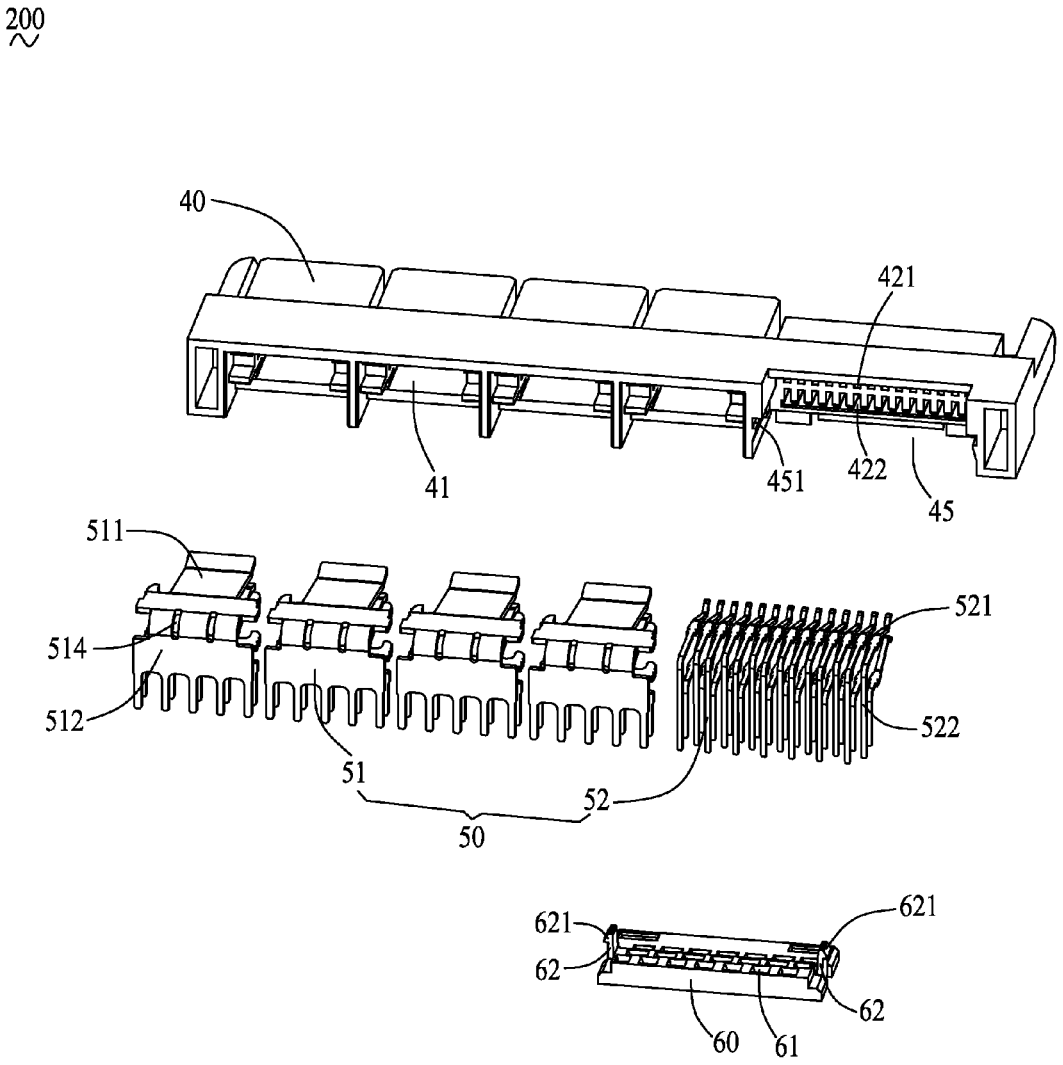
FIG. 9 is an exploded view of the receptacle connector as shown in FIG. 8.

Referring to FIGS. 8 and 9, the receptacle connector 200 includes a receptacle insulative housing 40 extending along a longitudinal direction, a plurality of receptacle contacts 50 fixed to the receptacle insulative housing 40 and a spacer 60 for mating with the receptacle insulative housing 40. The receptacle contacts 50 include four pairs of receptacle power contacts 51 and a plurality of receptacle signal contacts 52.

Figure 10:
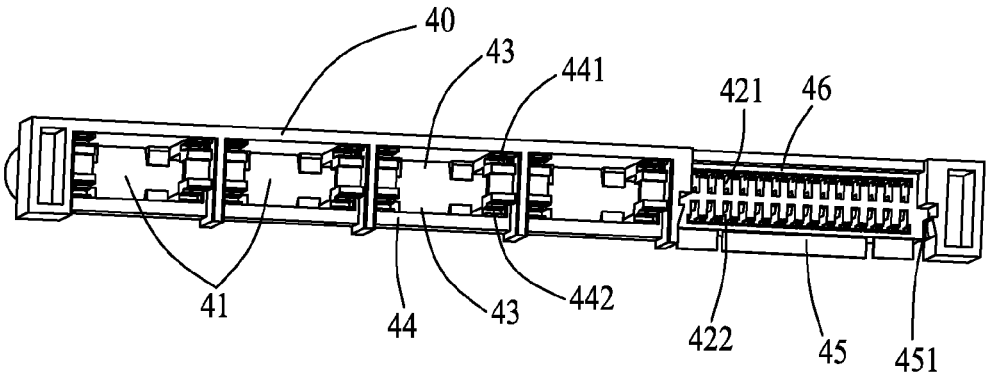
FIG. 10 is a perspective view of a receptacle insulative housing of the receptacle connector as shown in FIG. 9.
Figure 11:
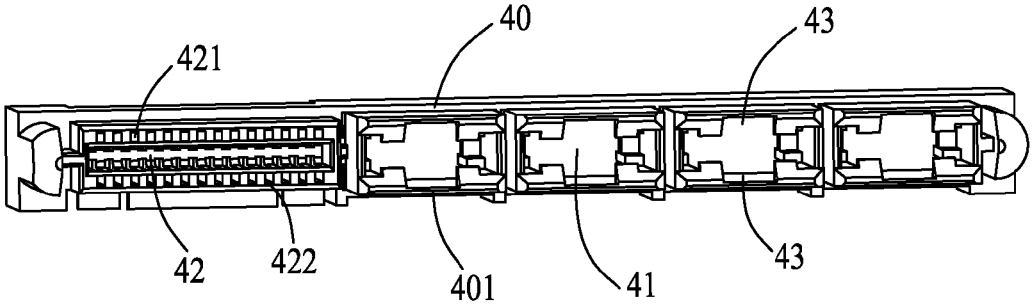
FIG. 11 is another perspective view of the receptacle insulative housing as shown in FIG. 10.

Referring to FIGS. 9 to 11, the receptacle insulative housing 40 includes a second mating surface 401, four first receptacle cavities 41 extending through the second mating surface 401 along a transverse direction perpendicular to the longitudinal direction, and a third rear wall 44 at a rear of each first receptacle cavity 41. Since four receptacle ports of the receptacle connector 200 are similar, only one of them will be described in detail hereinafter. Each first receptacle cavity 41 is enclosed by four peripheral walls (i.e., a top wall, a bottom wall and a pair of side walls). As shown in FIG. 10, the third rear wall 44 includes upper and lower receptacle contact slots 441, 442 in communication with corresponding first receptacle cavity 41 for receiving the receptacle power contacts 51.

Besides, in order for heat dissipation, the receptacle insulative housing 40 includes a second heat dissipation channel extending therethrough so as to be exposed to the air. As shown in FIG. 10, according to the illustrated embodiment of the present invention, the second heat dissipation channel includes a plurality of heat dissipation openings 43 extending through the third rear wall 44 along the transverse direction.

The receptacle connector 200 further includes a signal port aside the four receptacle ports along the longitudinal direction for mating with the signal port of the plug connector 100. Referring to FIGS. 9 to 11, the receptacle insulative housing 40 includes a second receptacle cavity 42, a plurality of upper and lower receptacle contact passageways 421, 422 in communication with the second receptacle cavity 42 and a fourth rear wall 46 at a rear of the second receptacle cavity 42. As shown in FIG. 10, the upper and lower receptacle contact passageways 421, 422 extend along a vertical direction and extend rearwardly through the fourth rear wall 46 along the transverse direction. The upper and lower receptacle contact passageways 421, 422 are of predetermined height, for one reason, the resilient receptacle signal contacts 52 can be inserted therefrom; and for another reason, the upper and lower receptacle contact passageways 421, 422 simultaneously function as heat dissipation routes.

Figure 12:
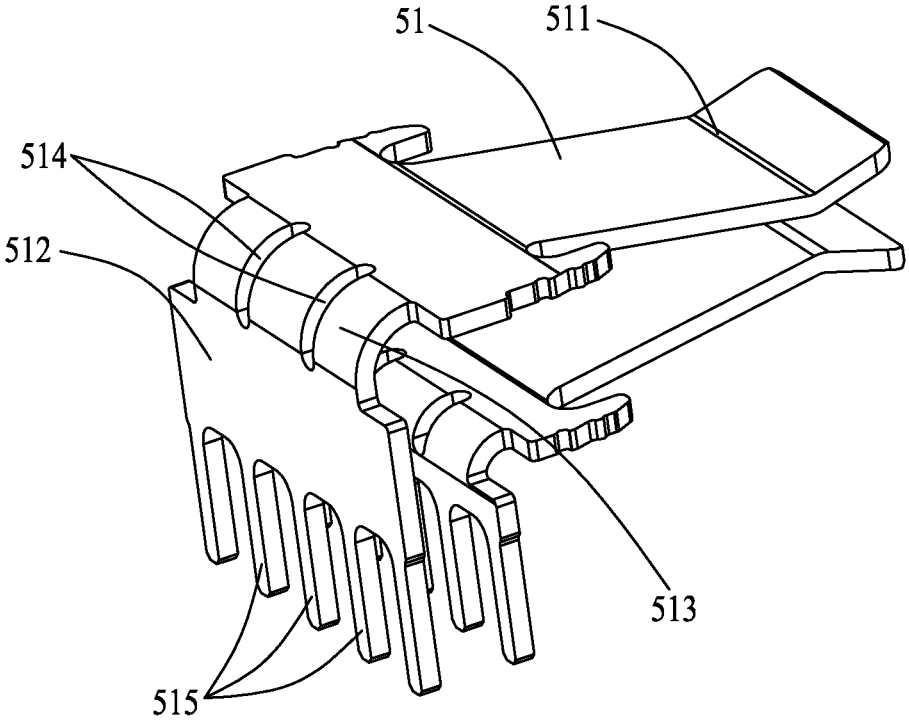
FIG. 12 is a perspective view of a pair of receptacle power contacts of the receptacle connector as shown in FIG. 9.

Referring to FIGS. 9 and 12, each pair of receptacle power contacts 51 are respectively received in the upper and lower plug contact slots 441, 442. Each receptacle power contact 51 includes a resilient contacting section 511, a second soldering section 512 for being mounted to a circuit board and a second bending section 513 connected between the resilient contacting section 511 and the second soldering section 512. The resilient contacting sections 511 extend into the first receptacle cavity 41 for engaging with corresponding flat contacting sections 211 of the plug power contacts 21. The second bending section 513 defines at least one heat dissipation slot 514 therethrough. The second soldering section 512 includes a plurality of soldering legs 515 for being soldered to the circuit board.

Figure 13:
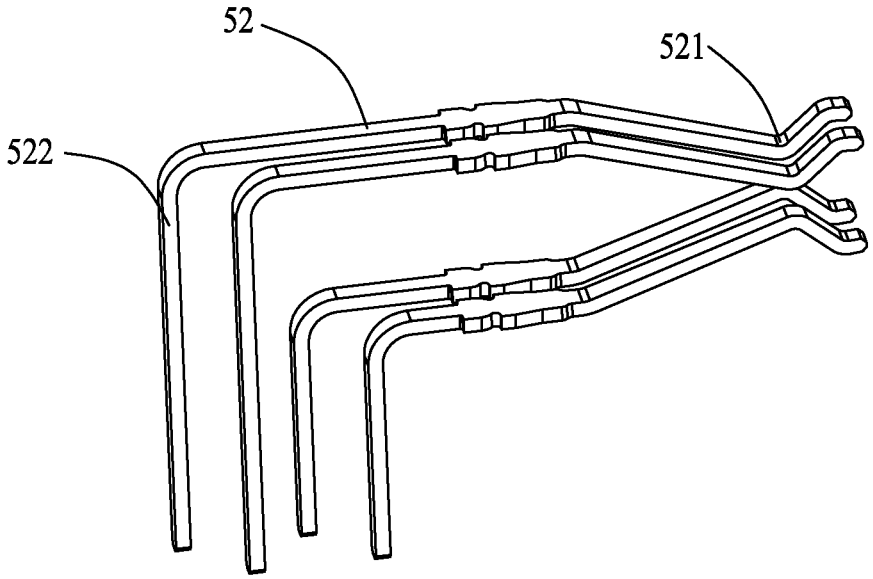
FIG. 13 is a perspective view of a plurality of receptacle signal contacts of the receptacle connector as shown in FIG. 9.

Referring to FIGS. 9 and 13, each receptacle signal contact 52 includes a resilient contacting portion 521 received in the upper or lower receptacle contact passageways 421, 422, and a second soldering portion 522 for being mounted to a circuit board. The resilient contacting portions 521 further extend into the second receptacle cavity 42 for mating with the flat contacting portions 221 of the plug signal contacts 22.

Referring to FIGS. 8 and 9, the receptacle insulative housing 40 includes an opening 45 at a rear of the fourth rear wall 46 and a pair of retaining apertures 451 located at opposite sides of the opening 45. In order to organize the second soldering portions 522 of the receptacle signal contacts 52, the receptacle connector 200 is also provided with a spacer 60 received in the opening 45. The spacer 60 includes a plurality of holes 61 through which the second soldering portions 522 extend and a pair of locking arms 62 extending from lateral sides thereof. Each locking arm 62 includes a hook 621 locked in retaining apertures 451.

When the receptacle connector 200 are mating with the plug connector 100, the receptacle insulative housing 40 is partly inserted in the first plug cavities 11 and the second plug cavity 12 of the plug insulative housing 10. Accordingly, the first plates 13 and the second plate 15 are inserted in the first receptacle cavities 41 and the second receptacle cavity 42, respectively. As a result, the resilient contacting sections 511 are engaging with corresponding flat contacting sections 211 for power transmission, and the resilient contacting portions 521 are engaging with corresponding flat contacting portions 221 for signal transmission.

Besides, the first heat dissipation channel and the second heat dissipation channel are in communication with each other. Both the first heat dissipation channel and the second heat dissipation channel are exposed to the air and together form a first path through which heat generated by the flat contacting sections 211 and the resilient contacting sections 511 can be effectively dissipated to the air. That is to say, the heat dissipation holes of the plug insulative housing 10 are in communication with the heat dissipation openings 43 of the receptacle insulative housing 40. In addition, heat generated by the flat contacting portions 221 and the resilient contacting portions 521 can be dissipated to the air through a second path formed by the upper and lower heat dissipation slits 181, 182 and the upper and lower receptacle contact passageways 421, 422.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A plug connector comprising:

a plug insulative housing comprising a first mating surface, a first plug cavity extending through the first mating surface along a transverse direction, and a first plate cantileveredly extending into the first plug cavity along the transverse direction, the plug insulative housing defining upper and lower plug contact slots in communication with the first plug cavity; and a pair of plug power contacts respectively received in the upper and lower plug contact slots, each plug power contact comprising a flat contacting section exposed to the first plug cavity and a first soldering section for being mounted to a circuit board; wherein the flat contacting sections of the pair of plug power contacts are positioned on upper and lower surfaces of the first plate, respectively; and wherein the plug insulative housing defining a heat dissipation channel in communication with the first plug cavity in order that heat generated by the flat contacting sections can be effectively dissipated to the air through the heat dissipation channel;

wherein each plug power contact comprises a first bending section connected between the flat contacting section and the first soldering section, the first bending section defining at least one heat dissipation slot therethrough.

2. The plug connector as claimed in claim 1, wherein the plug insulative housing comprises a front head formed at a distal end of the first plate, the front head comprising a pair of upper and lower protrusions extending along a vertical direction perpendicular to the transverse direction, front edges of the flat contacting sections of the pair of plug power contacts being restricted by and hid behind the pair of upper and lower protrusions, respectively.

3. The plug connector as claimed in claim 2, wherein the front head and the first plate are together of a T-shaped cross-section, and the front head is adapted for protecting the plug power contacts so as to prevent a mismatch connector from incorrectly contacting the flat contacting sections.

4. The plug connector as claimed in claim 2, wherein the plug insulative housing comprises four peripheral walls enclosing the first plug cavity and a first rear wall connecting the four peripheral walls, the first rear wall being opposite to the first mating surface, the first plate integrally extending from the first rear wall.

5. The plug connector as claimed in claim 4, wherein the upper and lower plug contact slots extend rearwardly through the first rear wall along the transverse direction, the first plate being located between the upper and lower plug contact slots along the vertical direction.

6. The plug connector as claimed in claim 4, wherein the heat dissipation channel comprises a plurality of heat dissipation holes extending through the first rear wall.

7. The plug connector as claimed in claim 6, wherein the heat dissipation holes comprise a pair of first holes located above the upper plug contact slot and a pair of second holes located below the lower plug contact slot, and the first holes and the second holes are formed on and respectively located at four corners of the first rear wall.

8. The plug connector as claimed in claim 7, wherein the first rear wall comprises a first slot between the pair of first holes along a longitudinal direction perpendicular to the transverse direction and the vertical direction, the first slot being in communication with the upper plug contact slot; and wherein the first holes and the first slot are separated by separate walls therebetween while taken from a rear view of the plug insulative housing.

9. The plug connector as claimed in claim 7, wherein the first rear wall comprises a second slot between the pair of second holes along a longitudinal direction perpendicular to the transverse direction and the vertical direction, the second slot being in communication with the lower plug contact slot; and wherein the second holes and the second slot are separated by separate walls therebetween while taken from a rear view of the plug insulative housing.

10. The plug connector as claimed in claim 1, wherein the plug insulative housing comprises a second plug cavity, a second plate extending into the second plug cavity and a second rear wall at a rear of the second plug cavity, the second plate defining a plurality of upper and lower plug contact passageways extending rearwardly through the second rear wall, the second rear wall further comprising a plurality of upper heat dissipation slits and a plurality of lower heat dissipation slits extending therethrough along the transverse direction, the upper heat dissipation slits being located above and in communication with the upper plug contact passageways, the lower heat dissipation slits being located below and in communication with the lower plug contact passageways, the upper heat dissipation slits and the lower heat dissipation slits being arranged in two parallel rows; and wherein the plug connector further comprises a plurality of plug signal contacts with flat contacting portions received in the upper and lower plug contact passageways, heat generated by the flat contacting portions can be dissipated to the air through the upper and lower heat dissipation slits.

11. A connector assembly comprising: a plug connector and a receptacle connector mateable with each other;

the plug connector comprising:

a plug insulative housing comprising a first mating surface, a first plug cavity extending through the first mating surface along a transverse direction, and a first plate cantileveredly extending into the first plug cavity along the transverse direction, the plug insulative housing defining upper and lower plug contact slots in communication with the first plug cavity; and a pair of plug power contacts respectively received in the upper and lower plug contact slots, each plug power contact comprising a flat contacting section exposed to the first plug cavity and a first soldering section, the flat contacting sections being positioned on upper and lower surfaces of the first plate, respectively;

the receptacle connector comprising:

a receptacle insulative housing at least partly received in the first plug cavity of the plug connector, the receptacle insulative housing comprising a second mating surface, a first receptacle cavity extending through the second mating surface along the transverse direction, and upper and lower receptacle contact slots in communication with the first receptacle cavity; and a pair of receptacle power contacts respectively received in the upper and lower receptacle contact slots, each receptacle power contact comprising a resilient contacting section engaging with corresponding flat contacting section of the plug power contact; wherein the plug insulative housing defines a first heat dissipation channel in communication with the first plug cavity, the receptacle insulative housing defines a second heat dissipation channel in communication with the first receptacle cavity, and the first heat dissipation channel and the second heat dissipation channel are in communication with each other; and wherein both the first heat dissipation channel and the second heat dissipation channel are exposed to the air and together form a first path through which heat generated by the flat contacting sections and the resilient contacting sections can be effectively dissipated to the air.

12. The connector assembly as claimed in claim 11, wherein the plug insulative housing comprises a front head formed at a distal end of the first plate, the front head comprising a pair of upper and lower protrusions extending along a vertical direction perpendicular to the transverse direction, front edges of the flat contacting sections of the pair of plug power contacts being restricted by and hid behind the pair of upper and lower protrusions, respectively.

13. The connector assembly as claimed in claim 11, wherein the plug insulative housing comprises a first rear wall at a rear of the first plug cavity, the receptacle insulative housing comprises a third rear wall at a rear of the first receptacle cavity; and wherein the first heat dissipation channel comprises a plurality of heat dissipation holes extending through the first rear wall, and the second heat dissipation channel comprises a plurality of heat dissipation openings extending through the third rear wall in such a manner that the heat dissipation holes are in communication with the heat dissipation openings.

14. The connector assembly as claimed in claim 13, wherein the heat dissipation holes comprise a pair of first holes located above the upper plug contact slot and a pair of second holes located below the lower plug contact slot, and the first holes and the second holes are respectively located at four corners of the first rear wall.

15. The connector assembly as claimed in claim 14, wherein the first rear wall comprises a first slot between the pair of first holes along a longitudinal direction perpendicular to the transverse direction and a vertical direction, the first slot being in communication with the upper plug contact slot; and wherein the first holes and the first slot are separated by separate walls therebetween while taken from a rear view of the plug insulative housing.

16. The connector assembly as claimed in claim 14, wherein the first rear wall comprises a second slot between the pair of second holes along a longitudinal direction perpendicular to the transverse direction and a vertical direction, the second slot being in communication with the lower plug contact slot; and wherein the second holes and the second slot are separated by separate walls therebetween while taken from a rear view of the plug insulative housing.

17. The connector assembly as claimed in claim 11, wherein each plug power contact comprises a first soldering section and a first bending section connected between the flat contacting section and the first soldering section, the first bending section defining at least one heat dissipation slot therethrough; and wherein each receptacle power contact comprises a second soldering section and a second bending section connected between the resilient contacting section and the second soldering section, the second bending section defining at least one heat dissipation slot therethrough.

18. The connector assembly as claimed in claim 13, wherein the plug insulative housing comprises a second plug cavity, a second plate extending into the second plug cavity and a second rear wall at a rear of the second plug cavity, the second plate defining a plurality of upper and lower plug contact passageways extending rearwardly through the second rear wall, the second rear wall further comprising a plurality of upper heat dissipation slits extending upwardly along a vertical direction and a plurality of lower heat dissipation slits extending downwardly along the vertical direction, the upper heat dissipation slits being in communication with corresponding upper plug contact passageways, the lower heat dissipation slits being in communication with corresponding lower plug contact passageways; and wherein the plug connector further comprises a plurality of plug signal contacts with flat contacting portions received in the upper and lower plug contact passageways, heat generated by the flat contacting portions can be dissipated to the air through the upper and lower heat dissipation slits.

19. The connector assembly as claimed in claim 18, wherein the receptacle insulative housing comprises a second receptacle cavity and a fourth rear wall at a rear of the second receptacle cavity, the fourth rear wall defining a plurality of upper and lower receptacle contact passageways extending rearwardly therethrough; wherein the receptacle connector further comprises a plurality of receptacle signal contacts with resilient contacting portions received in the upper and lower receptacle contact passageways; and wherein the flat contacting portions and the resilient contacting portions engage with each other for signal transmission, and heat generated thereby can be dissipated to the air through a second path formed by the upper and lower heat dissipation slits and the upper and lower receptacle contact passageways.

20. A plug connector comprising:

a plug insulative housing comprising a first mating surface, a first plug cavity extending through the first mating surface along a transverse direction, and a first plate cantileveredly extending into the first plug cavity along the transverse direction, the plug insulative housing defining upper and lower plug contact slots in communication with the first plug cavity; and a pair of plug power contacts respectively received in the upper and lower plug contact slots, each plug power contact comprising a flat contacting section exposed to the first plug cavity and a first soldering section for being mounted to a circuit board; wherein the flat contacting sections of the pair of plug power contacts are positioned on upper and lower surfaces of the first plate, respectively; and wherein the plug insulative housing defining a heat dissipation channel in communication with the first plug cavity in order that heat generated by the flat contacting sections can be effectively dissipated to the air through the heat dissipation channel;

wherein the plug insulative housing comprises a second plug cavity, a second plate extending into the second plug cavity and a second rear wall at a rear of the second plug cavity, the second plate defining a plurality of upper and lower plug contact passageways extending rearwardly through the second rear wall, the second rear wall further comprising a plurality of upper heat dissipation slits and a plurality of lower heat dissipation slits extending therethrough along the transverse direction, the upper heat dissipation slits being located above and in communication with the upper plug contact passageways, the lower heat dissipation slits being located below and in communication with the lower plug contact passageways, the upper heat dissipation slits and the lower heat dissipation slits being arranged in two parallel rows; and wherein the plug connector further comprises a plurality of plug signal contacts with flat contacting portions received in the upper and lower plug contact passageways, heat generated by the flat contacting portions can be dissipated to the air through the upper and lower heat dissipation slits.

* * * * *